US011426317B2

(12) United States Patent
Dirauf et al.

(10) Patent No.: US 11,426,317 B2
(45) Date of Patent: Aug. 30, 2022

(54) TRANSPORT DEVICE AND METHOD OF OPERATING SUCH TRANSPORT DEVICE

(71) Applicant: Siemens Healthcare GmbH, Erlangen (DE)

(72) Inventors: Franz Dirauf, Bad Staffelstein (DE); Thorsten Gecks, Bayreuth (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 16/475,419

(22) PCT Filed: Sep. 1, 2017

(86) PCT No.: PCT/EP2017/071950
§ 371 (c)(1),
(2) Date: Jul. 2, 2019

(87) PCT Pub. No.: WO2018/130315
PCT Pub. Date: Jul. 19, 2018

(65) Prior Publication Data

US 2019/0343701 A1 Nov. 14, 2019

(30) Foreign Application Priority Data

Jan. 13, 2017 (EP) ..... 17151426

(51) Int. Cl.
*A61G 7/08* (2006.01)
*B66F 9/06* (2006.01)
(Continued)

(52) U.S. Cl.
CPC ..... *A61G 7/08* (2013.01); *B66F 9/063* (2013.01); *B66F 9/065* (2013.01);
(Continued)

(58) Field of Classification Search
CPC ..... A61G 7/08; A61G 2203/22; B66F 9/063; B66F 9/065; B66F 9/007522; B66F 9/07572; B66F 9/18
See application file for complete search history.

(56) References Cited

U.S. PATENT DOCUMENTS 4,273,217 A * 6/1981 Kajita ..... A61G 3/06 187/200
RE31,178 E * 3/1983 Deacon ..... A61G 3/062 414/546
(Continued)

FOREIGN PATENT DOCUMENTS

CN 1438864 A 8/2003
CN 201597499 U 10/2010
(Continued)

OTHER PUBLICATIONS

International Search Report and Written Opinion for PCT/EP2017/071950 dated Sep. 1, 2017 dated Dec. 4, 2017.
(Continued)

*Primary Examiner* — Saul Rodriguez
*Assistant Examiner* — Ashley K Romano
(74) *Attorney, Agent, or Firm* — Harness, Dickey & Pierce, P.L.C.

(57) ABSTRACT

A transport device is for carrying and moving objects from one location to another. In an embodiment, the transport device includes a chassis and at least four motor-driven omnidirectional wheels arranged on the chassis. The chassis is configured to adapt the wheelbase and the track gauge of the omnidirectional wheels according to the size of the object. A corresponding method for operating such transport device is further specified in an embodiment. The embodiments of the application lie in the universal usage of the transport device for nearly all sizes and shapes of an object.

16 Claims, 6 Drawing Sheets

(51) Int. Cl.
*B66F 9/075* (2006.01)
*B66F 9/18* (2006.01)
*B66F 9/065* (2006.01)

(52) U.S. Cl.
CPC ..... *B66F 9/07522* (2013.01); *B66F 9/07572* (2013.01); *B66F 9/18* (2013.01); *A61G 2203/22* (2013.01)

(56) References Cited

U.S. PATENT DOCUMENTS

| | | | | |
|---|---|---|---|---|
| 4,466,771 | A * | 8/1984 | Thorley | B60P 1/4421 105/431 |
| 4,953,665 | A * | 9/1990 | Paquin | A61G 3/063 187/279 |
| 5,180,275 | A * | 1/1993 | Czech | A61G 3/06 187/200 |
| 5,697,109 | A | 12/1997 | Hodgetts et al. | |
| 6,019,565 | A | 2/2000 | Gesuale | |
| 6,619,620 | B1 * | 9/2003 | Carter | B66F 7/08 254/10 C |
| 7,445,416 | B2 * | 11/2008 | O'Leary | B60P 1/4442 414/546 |
| 7,926,618 | B2 * | 4/2011 | Zuercher | B60P 1/4471 187/200 |
| 10,406,047 | B1 * | 9/2019 | Runnels | A61G 5/104 |
| 10,869,793 | B1 * | 12/2020 | Runnels | A61G 5/104 |
| 2002/0084116 | A1 | 7/2002 | Ruschke et al. | |
| 2006/0182581 | A1 * | 8/2006 | Murray | B66B 9/0869 414/541 |
| 2009/0298653 | A1 | 12/2009 | Rodetsky et al. | |
| 2011/0214588 | A1 | 9/2011 | Grübling et al. | |
| 2011/0238217 | A1 | 9/2011 | Kume et al. | |
| 2012/0023661 | A1 * | 2/2012 | Ota | A61G 7/1048 5/86.1 |
| 2012/0029697 | A1 | 2/2012 | Ota et al. | |
| 2014/0094997 | A1 | 4/2014 | Hyde et al. | |
| 2014/0130258 | A1 | 5/2014 | Kobuss | |
| 2015/0216746 | A1 | 8/2015 | Dirauf et al. | |
| 2016/0136018 | A1 | 5/2016 | Deluca et al. | |
| 2016/0368747 | A1 * | 12/2016 | O'Connell | B66F 9/065 |
| 2017/0120443 | A1 * | 5/2017 | Kang | B25J 9/0084 |
| 2017/0181911 | A1 * | 6/2017 | Fakhrizadeh | A61G 7/1017 |
| 2017/0196748 | A1 * | 7/2017 | Gaiser | A61G 13/04 |
| 2017/0281441 | A1 | 10/2017 | Fich | |

FOREIGN PATENT DOCUMENTS

| | | | |
|---|---|---|---|
| CN | 104814847 | A | 8/2015 |
| CN | 205417314 | U | 8/2016 |
| EP | 2039336 | A2 | 3/2009 |
| WO | WO 9613239 | A1 | 5/1996 |
| WO | WO 200809621 | | 8/2008 |
| WO | WO-2008129847 | A1 | 10/2008 |

OTHER PUBLICATIONS

Extended European Search Report 17151426.8 dated Jul. 5, 2017.
Japanese Office Action and English translation thereof dated Jun. 23, 2020.
Chinese Office Action and English translation thereof dated Jul. 6, 2020.
Office Action for Korean Patent Application No. 10-2019-7023305 dated Dec. 7, 2020 and English translation thereof.
Notice of Allowance for Japanese Patent Application No. 2019-538214 dated Feb. 2, 2021 and English translation thereof.
Office Action for Chinese Patent Application No. 201760083216.0 dated Apr. 22, 2021.
Office Action for Korean Patent Application No. 10-2019-7023305 dated Jun. 22, 2021 and English translation thereof.
Office Action for Chinese Patent Application No. 201780083216.0 dated Jul. 29, 2021 and English translation thereof.
Li Weiguo et al.: "Creative Star: Modular Robot Design and Competition, the 2nd edition": pp. 169-170; Beihang University Press; Sep. 2016. (English translation attached).

* cited by examiner

TRANSPORT DEVICE AND METHOD OF OPERATING SUCH TRANSPORT DEVICE

PRIORITY STATEMENT

This application is the national phase under 35 U.S.C. § 371 of PCT International Application No. PCT/EP2017/071950 which has an International filing date of Sep. 1, 2017 and which claims priority to European Application No. EP 17151426.8 filed Jan. 13, 2017 the entire contents of each of which are hereby incorporated herein by reference.

FIELD

An embodiment of the present application generally relates to a transport device and a related method of operation for transporting objects, e.g. sick beds or containers, in buildings, particularly in hospitals.

BACKGROUND

In hospitals, many patients are transported in their sick beds by the medical staff by pushing them through the buildings by hand. In many cases, more than one person is needed to maneuver the sick bed. In addition, after usage each patient bed has to be cleaned and disinfected in a special room, then moved to a storage room and then back to the patient room. Furthermore, in hospitals different types of goods have to be transported in containers and rolling cupboards over long distances within the hospital buildings.

Therefore, many transport processes have to be carried out by the staff, which is time-consuming and physical power-consuming as well.

In most cases, the above mentioned transport is carried out manually by the personnel. Only in few hospitals there are driverless transport systems which perform the transport on separate traffic lanes or areas.

SUMMARY

Embodiments of the present application provide a device and/or a method for easily moving sick beds and other objects throughout a hospital building. At least one embodiment of the present invention provides a transport device and/or a method of operating the transport device. Advantageous embodiments are provided in the claims.

At least one embodiment of the invention is directed to a transport device for carrying and moving an object from one location to another, comprising a chassis and at least four motor-driven (=motorized) omnidirectional wheels arranged on the chassis, whereas the chassis is configured to adapt the wheelbase and the track gauge of the omnidirectional wheels according to the size of the object by movement of at least one motor-driven omnidirectional wheel. An advantage of at least one embodiment of the invention lies in the universal usage of the transport device for nearly all sizes and shapes of an object.

Furthermore, at least one embodiment of the invention is directed to a method for automatically operating a transport device according to an embodiment of the invention, comprising:

driving the transport device to the object,
lifting the object and
transporting the object to a destination.

LIST OF REFERENCE SIGNS

Figure 1:
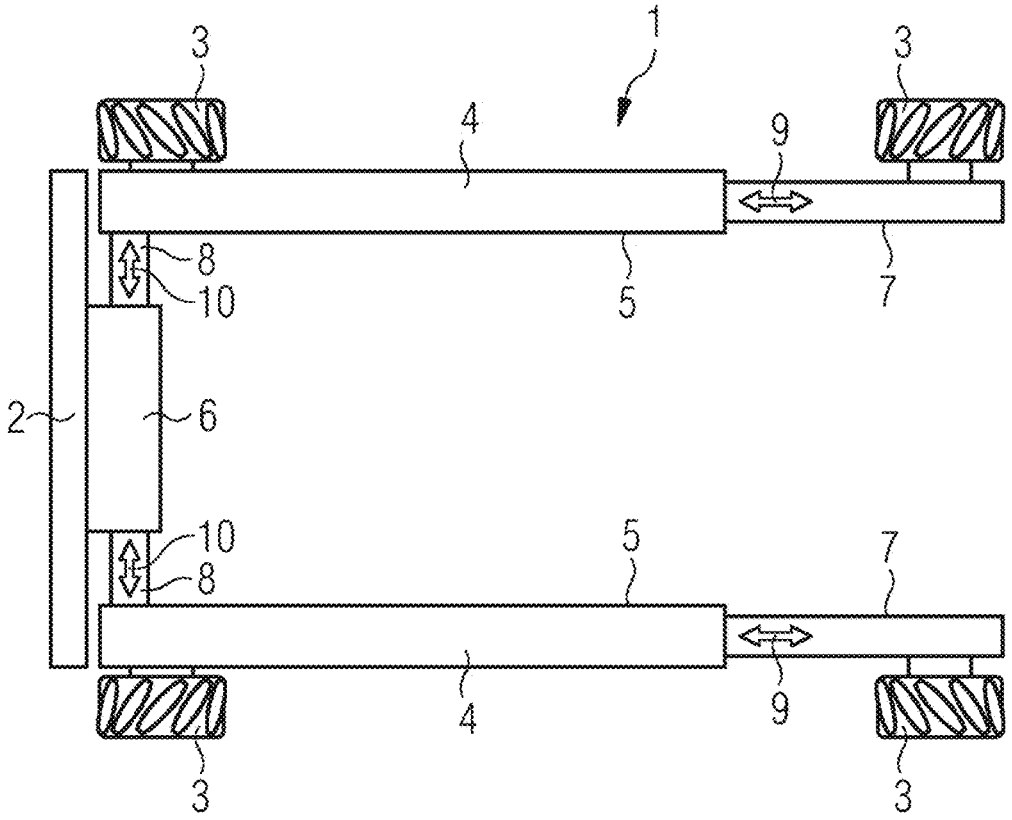
FIG. 1: shows a top view of a transport device.

1 chassis
2 base body
3 motor-driven omnidirectional wheel
4 prong
5 first linear guiding sleeve
6 second linear guiding sleeve
7 first extraction
8 second extraction
9 direction of longitudinal extraction
10 direction of lateral extraction
11 lifting device
12 blade
13 roller
14 direction of folding
15 lifting traverse
16 traverse mover
17 sick bed
18 wheel of sick bed 17
19 container
20 floor

DETAILED DESCRIPTION OF THE INVENTION

According to at least one embodiment of the invention, the transport device comprises a mobile transport platform with motor-driven omnidirectional wheels. By its variable geometry, the transport device can be automatically adapted to different transport tasks in hospitals, but is suitable for general logistics tasks in buildings as well.

Omnidirectional wheels (as well called omni wheels, poly wheels or multidirectional wheels) roll forward like normal wheels but can slide sideways with nearly no friction. Omnidirectional wheels are conventional wheels with a series of rollers attached to its circumference.

The transport device (or trolley or cart) is mainly designed for the transport of sick beds. Empty sick beds can be autonomously transported throughout the hospital with the help of a fully automatic control system with sensors and navigation function. When a patient is lying in the sick bed, the transport device is accompanied by a nurse, who is mainly concerned with the patient.

In the case the movements of the transport device are partially autonomously executed, the accompanying nurse does not need to control the transport device. The navigation and avoidance of collisions are still carried out automatically by the control unit with connected sensors. However, the movement of the platform adapts to the speed and direction of the accompanying person, so that they nurse can focus on the patient.

In addition to carrying different types of sick beds, the transport device can be used for other transport purposes, e.g. material containers or wheelchairs, due to its variable geometry. An essential advantage of the transport device is its omnidirectional chassis, which allows an easy placing underneath objects and moving without difficult steering maneuvers.

At least one embodiment of the invention is directed to a transport device for carrying and moving an object from one location to another, comprising a chassis and at least four motor-driven (=motorized) omnidirectional wheels arranged on the chassis, whereas the chassis is configured to adapt the wheelbase and the track gauge of the omnidirectional wheels according to the size of the object by movement of at least one motor-driven omnidirectional wheel. An advantage of at least one embodiment of the invention lies in the universal usage of the transport device for nearly all sizes and shapes of an object.

In a further embodiment of the invention, the omnidirectional wheels are of the Mecanum type and electrical motorized.

In a further embodiment, the transport device comprises at least one lifting device arranged on the chassis, which is configured to lift the object for transportation.

Furthermore, the chassis has the shape of a two-pronged fork, whereas the omnidirectional wheels are arranged on two prongs. In a further embodiment, the prongs can be elongated and adaptable in width and/or the lifting device is arranged on the prong.

In a further embodiment, the lifting device comprises a blade configured device, configured to slip under the wheel of a sick bed and lifting the wheel. In a further embodiment of the invention, the chassis is foldable in order to save storage space and/or the prongs are configured to move in a vertical position in a storage mode. Furthermore, the transport device comprises sensors, which are configured to interact with the surrounding and a control unit connected with the sensors, which is configured to autonomously and automatically move the transport device. These features have the advantage of enabling autonomous or semi-autonomous movement of the transport device.

Furthermore, at least one embodiment of the invention is directed to a method for automatically operating a transport device according to an embodiment of the invention, comprising:

driving the transport device to the object, lifting the object and transporting the object to a destination.

In a further embodiment of the method, the prongs are adapted in length and lateral distance in order to be adapted to the size of the object. This is performed by the active movement (rotation and sliding) of at least one omnidirectional wheel. Further benefits and advantages of the present invention will become apparent after a careful reading of the detailed description with appropriate reference to the accompanying drawings.

Figure 2:
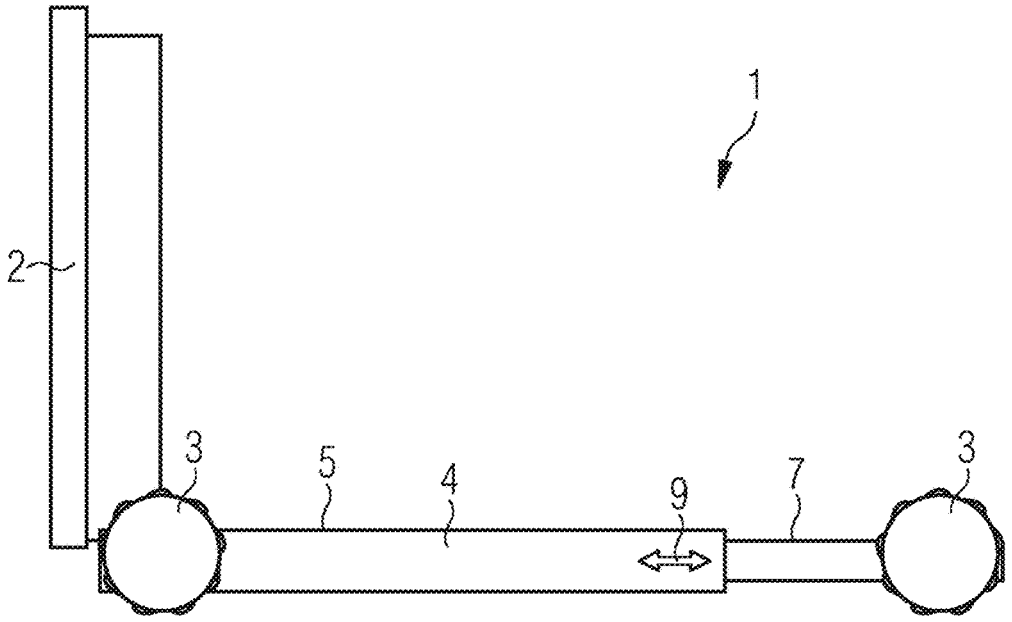
FIG. 2: shows a side view of a transport device.
Figure 4:
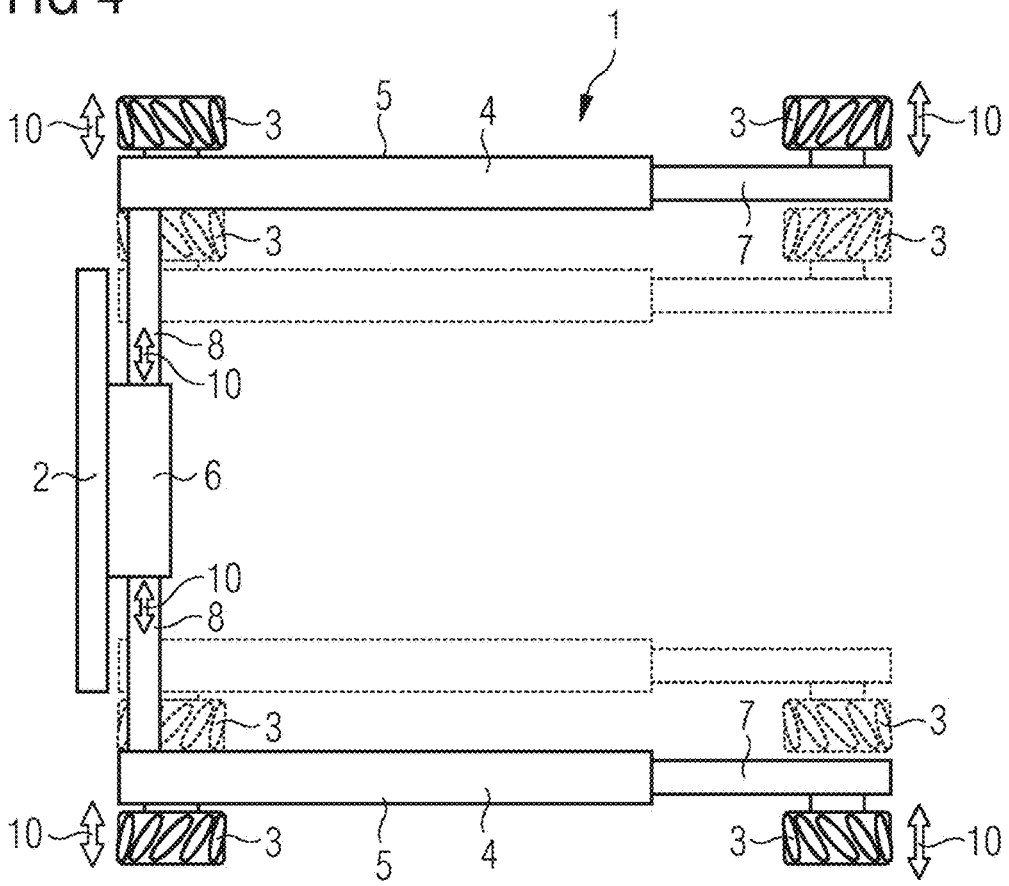
FIG. 4: shows a top view of a transport device with two different lateral positions of the chassis.
Figure 5:
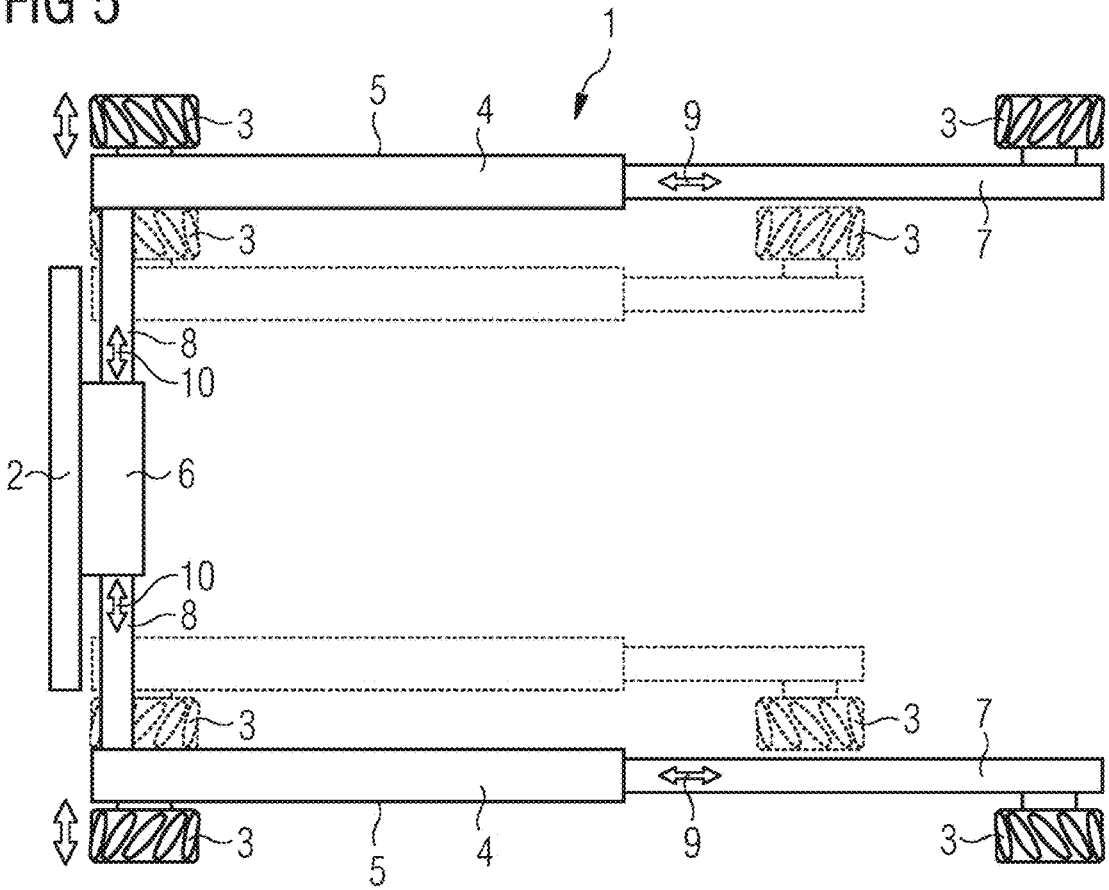
FIG. 5: shows a top view of a transport device with four different positions of the chassis.
Figure 6:
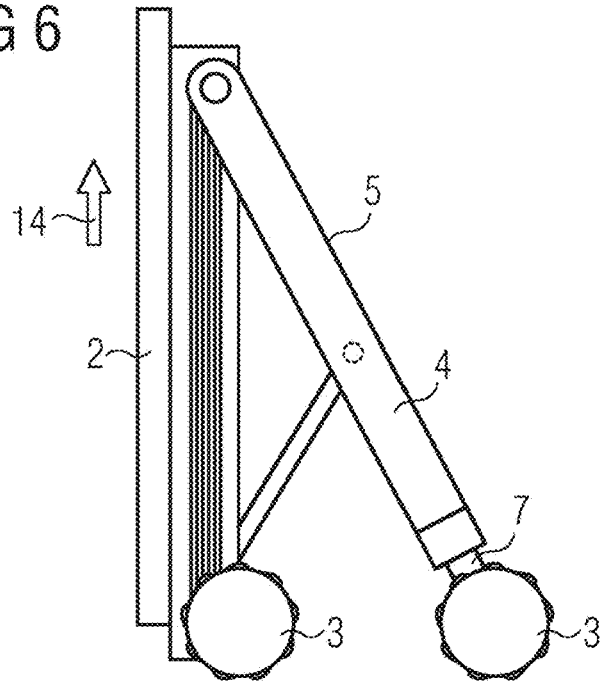
FIG. 6: shows a side view of a transport device with a folded chassis.

FIG. 1 to FIG. 6 show a transport device for lifting and transporting an object, e.g. a sick bed. FIG. 1 and FIG. 3 to FIG. 5 show a top view of the transport device, while FIG. 2 and FIG. 6 show a side view of the transport device. The transport device comprises a horizontal oriented chassis 1 fixed on a vertical oriented base body 2.

The chassis 1 has the shape of a two-pronged fork comprising two parallel oriented prongs 4 which can be elongated and laterally moved. Therefore, the wheelbase (direction 9) and the track gauge (direction 10) of the chassis can be varied and adapted to the size of an object to be transported. Responsible for this variation are four individually motor-driven omnidirectional wheels 3 arranged on the prongs 4, two on each prong 4. Preferably, the motorized omnidirectional wheel 3 uses an electrical motor for driving.

Each prong 4 comprises a first linear guiding sleeve 5 and a first extension 7, which can be pulled into and moved out of the first linear guiding sleeve 5 by movement of the motor-driven omnidirectional wheel 3. Thus, the wheelbase of the chassis 1 can be varied. For variation of the track gauge, the chassis 1 comprises a second linear guiding sleeve 6, rectangular arranged to the prongs 4, and a second extension 8, which can be pulled into and moved out of the second linear guiding sleeve 6 causing the variation of the track gauge due to movement of the omnidirectional wheel 3.

Preferably, the omnidirectional wheels 3 are of the Mecanum type. The base body 2 can comprise a control unit for autonomous movement of the transport device and batteries for sup-plying the motor-driven omnidirectional wheels 3 with electrical power.

Figure 3:
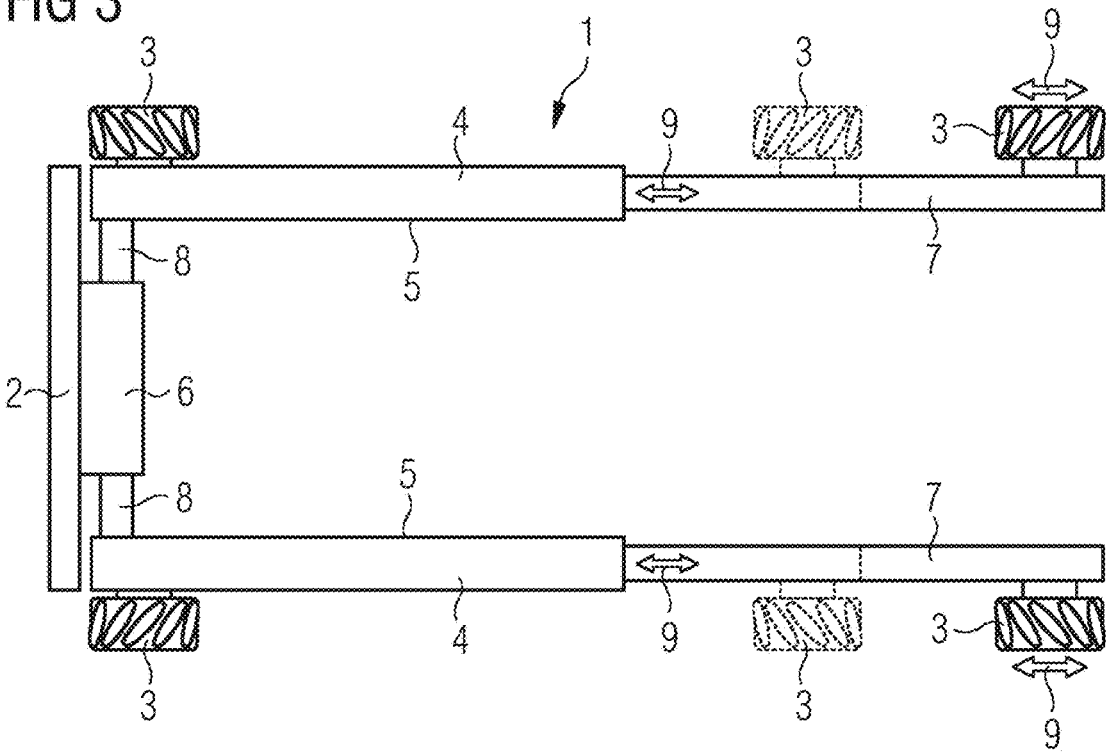
FIG. 3: shows a top view of a transport device with two different longitudinal positions of the chassis.

FIG. 3 shows a variation (direction 9) of the wheelbase from one into another position. FIG. 4 shows a variation (direction 10) of the track gauge from one into another position. FIG. 5 shows a variation (direction 9 and direction 10) of the wheelbase and track gauge from one into another position.

FIG. 6 shows the transport device of FIG. 1 to FIG. 5 in a folded position. Therefore, the prongs 4 can move vertically upwards (direction 14), whereas the wheelbase is significantly reduced. In such a position the transport device can easily be stored in a small space or easily maneuvered in tight space.

Figure 7:
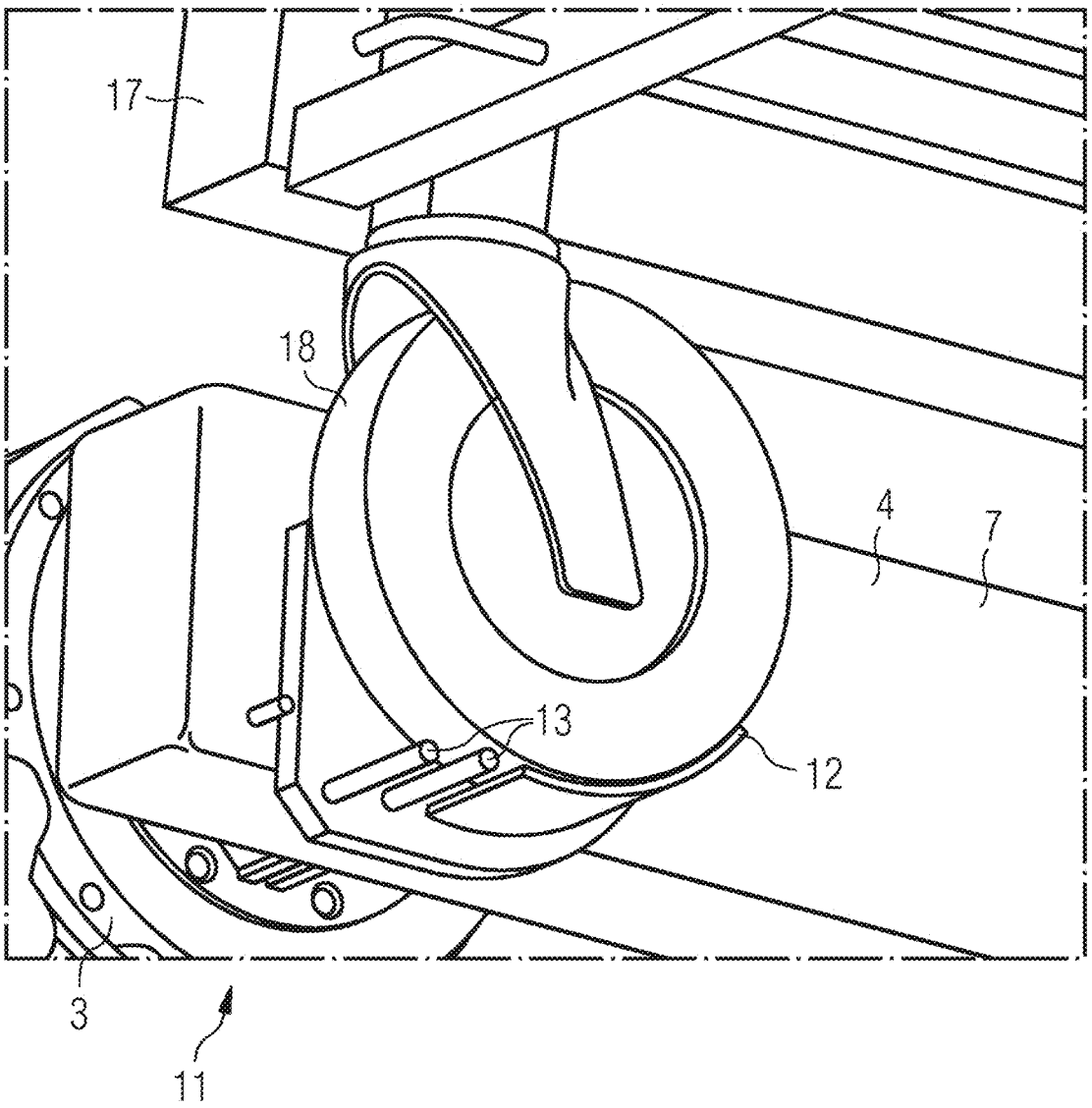
FIG. 7: shows a spatial view of a lifting device for sick beds.

FIG. 7 shows an embodiment of a lifting device 11 of the transport device in a spatial view. The lifting device 11 is inwardly mounted on the first extraction 7 of a prong 4. The omnidirectional wheel 3 is mounted outwardly. The lifting device 11 comprises two rollers 13 and blade 12 both mounted on a base plate. Rollers 13 and blade 12 form a curved structure, which can easily slip under a wheel 18 of a sick bed 17 or any other object with wheels. By slipping the rollers 13 and the blade 12 under the wheel 18 the wheel 18 is lifted. Slipping is induced by a movement of the first extraction 7 due to a movement of the omnidirectional wheel 3. Since the rollers 13 are able to rotate along their axis blocked or locked wheels 18 are able to glide onto the lifting device 11.

Figure 8:
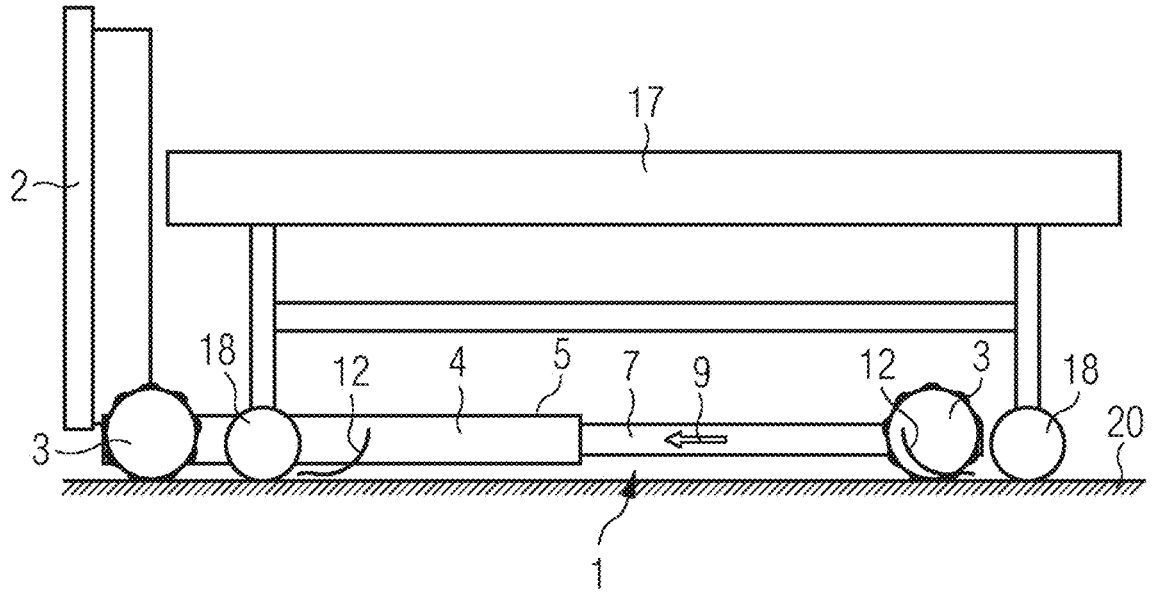
FIG. 8: shows a side view of a transport device approaching a sick bed.
Figure 9:
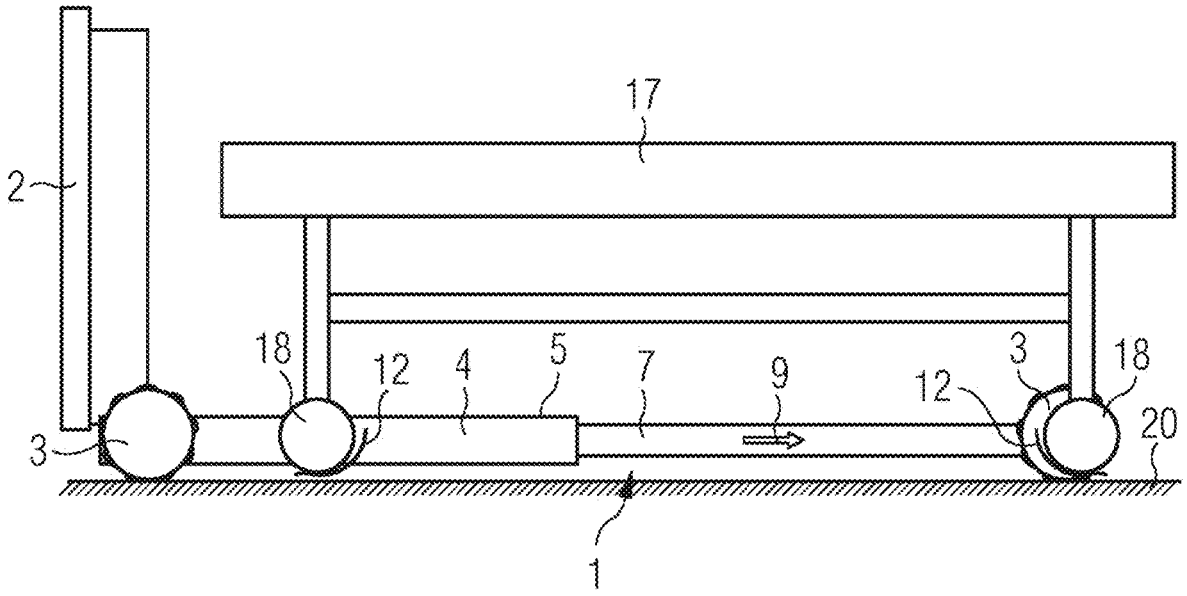
FIG. 9: shows a side view of a transport device lifting a sick bed.

FIG. 8 and FIG. 9 show the lifting of a sick bed 17 by a transport device in detail. The sick bed 17 comprises wheels 18 resting on the floor 20. The transport device comprises a base body 2 and a chassis 1. The chassis 1 comprises two prongs 4 consisting of first linear guiding sleeves 5 and first extractions 7 which can move in direction 9 by movement of the omnidirectional wheel 3 mounted on the first extraction 7. The first extraction 7 can be locked in any longitudinal position.

In FIG. 8 the blades 12 of the lifting device are moved closely to the wheels 18 of the sick bed 17. In FIG. 9 the first extraction 7 has been moved in direction 9 and the blades 12 have been slipped under the wheels 18 while lifting the sick bed 18. The first extraction 7 is blocked and the transport device is able to carry the sick bed 17 to its destination.

Figure 10:
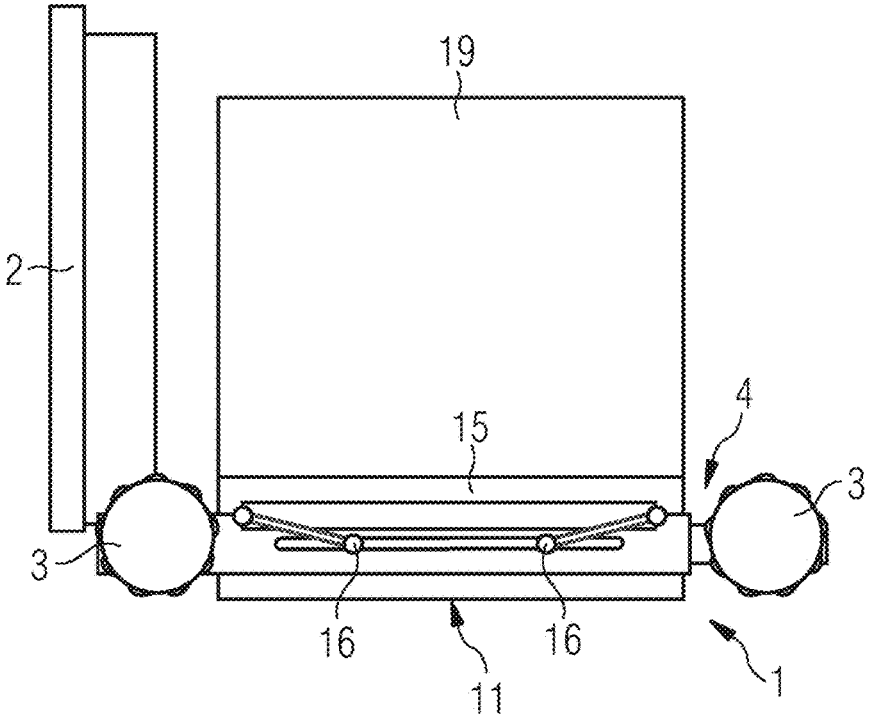
FIG. 10: shows a side view of a transport device approaching a container.
Figure 11:
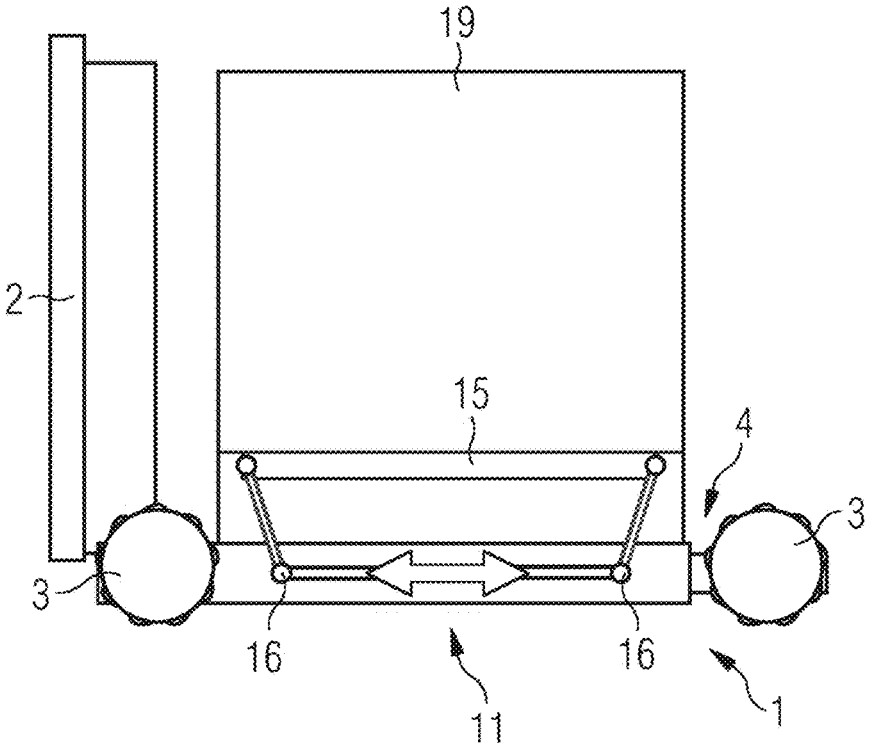
FIG. 11: shows a side view of a transport device lifting a container.

FIG. 10 and FIG. 11 show the lifting of a container 19 by a transport device in detail. The container 19 rests on a floor. The transport device comprises a base body 2 and a chassis 1. The chassis 1 comprises two prongs 4 with omnidirectional wheel 3 mounted on the prongs 4. Due to the possibility of adapting the wheelbase and the track gauge or the chassis 1 the lifting devices 11 mounted on the prongs 4 can move close to the container 19. The lifting device 11 comprises a lifting traverse 15 which can be moved up and down by movement of the traverse mover 16 in the direction of the arrow as depicted in FIG. 11. In FIG. 10 the container 19 rests on the floor. In FIG. 11 the container 19 is lifted and is ready for being carried to its destination.

Equipped with sensors interacting with the surroundings and a control unit connected with the sensors, the transport device is capable of moving autonomously or semi-autonomously from one location to another.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A transport device for carrying and moving an object from one location to another, comprising:

a chassis having parallel prongs, each of the parallel prongs having a guide sleeve, and the chassis further having a linear guide sleeve connecting the prongs;

at least one movable extension in each guide sleeve; and at least four motor-driven omnidirectional wheels arranged on the chassis, the chassis being configured to adapt a wheel-base and a track gauge of the at least four motor-driven omnidirectional wheels, via movement of at least one movable extension relative to its respective guide sleeve, according to a size of the object by movement of at least one motor-driven omnidirectional wheel of the at least four motor-driven omnidirectional wheels, wherein in an unfolded state the chassis is oriented horizontally and a base body of the transport device is oriented vertically relative to the chassis, and in a folded state, the prongs are rotated relative to the base body such that the chassis is foldable for storage, and wherein an end portion of the prongs closest to the chassis are configured to move vertically alone the base body into a mode for storage.

2. The transport device of claim 1, wherein the at least four motor-driven omnidirectional wheels are electrical motorized Mecanum wheels.

3. The transport device of claim 2, further comprising:

at least one lifting device, arranged on the chassis, configured to lift the object for transportation.

4. The transport device of claim 2, wherein the chassis has a shape of a two-pronged fork, and wherein the at least four motor-driven omnidirectional wheels are arranged on prongs of the two-pronged fork.

5. The transport device of claim 1, further comprising:

at least one rotatable lifting device, arranged on the chassis, configured to lift the object for transportation.

6. The transport device of claim 5, wherein the chassis has a shape of a two-pronged fork, and wherein the at least four motor-driven omnidirectional wheels are arranged on prongs of the two-pronged fork.

7. The transport device of claim 6, wherein the prongs are capable elongatable and adaptable in width.

8. The transport device of claim 6, wherein the at least one lifting device is arranged on at least one of the prongs and is rotatable to a position beneath the at least one prong.

9. The transport device of claim 5, wherein the at least one rotatable lifting device includes a blade and at least one roller, configured to slip under a wheel of the object, to thereby lift the wheel, the at least one wheel configured to contact a floor when the at least one extendable lifting device is in a rotated state.

10. The transport device of claim 1, wherein the object is a sick bed.

11. The transport device of claim 1, further comprising:

sensors, configured to interact with surroundings; and a control unit, connected with the sensors, configured to autonomously and automatically move the transport device.

12. The transport device of claim 1, wherein the chassis has a shape of a two-pronged fork, and wherein the at least four motor-driven omnidirectional wheels are arranged on prongs of the two-pronged fork.

13. The transport device of claim 1, wherein the chassis is foldable.

14. The transport device of claim 1, wherein the at least one movable extension is pulled into and moved out of its respective guide sleeve by movement of a motor-driven omnidirectional wheel.

15. A method for automatically operating a transport device including a horizontally oriented chassis and a base body oriented vertically relative to the chassis, the chassis having a plurality of guide sleeves and at least one movable extension in each guide sleeve and at least four motor-driven omnidirectional wheels arranged on the chassis, the chassis being configured to adapt a wheelbase and a track gauge of the at least four motor-driven omnidirectional wheels according to a size of an object to be moved by movement of at least one motor-driven omnidirectional wheel of the at least four motor-driven omnidirectional wheels, the method comprising:

adapting a wheel-base and a track gauge of the at least four motor-driven omnidirectional wheels, via movement of at least one of the movable extensions relative to its respective guide sleeve, according to the size of the object by movement of at least one motor-driven omnidirectional wheel of the at least four motor-driven omnidirectional wheels;

and, moving an end of the prongs closest to the base body vertically along the base body into a mode for storage.

16. The method of claim 15, wherein the transport device includes at least one lifting device, arranged on the chassis, configured to lift the object for transportation, wherein the chassis has a shape of a two-pronged fork, and wherein the at least four motor-driven omnidirectional wheels are arranged on prongs of the two-pronged fork, and wherein the prongs are elongatable and adaptable in width, the method further comprising:

adapting the prongs, in length and lateral distance, to be adapted to the size of the object.

* * * * *